US006190474B1

(12) United States Patent
Yamato

(10) Patent No.: US 6,190,474 B1
(45) **Date of Patent: *Feb. 20, 2001**

(54) GAS GENERATING COMPOSITION

(75) Inventor: Yo Yamato, Himeji (JP)

(73) Assignee: Daicel Chemical Industries, Ltd., Osaka (JP)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/068,688

(22) PCT Filed: Nov. 13, 1996

(86) PCT No.: PCT/JP96/03327

§ 371 Date: May 14, 1998

§ 102(e) Date: May 14, 1998

(87) PCT Pub. No.: WO97/18178

PCT Pub. Date: May 22, 1997

(30) Foreign Application Priority Data

Nov. 14, 1995 (JP) ..... 7-295148

(51) Int. Cl.[7] ..... C06B 45/10; C06B 31/28
(52) U.S. Cl. ..... 149/19.1; 149/61
(58) Field of Search ..... 149/62, 38, 61, 149/19.1, 19.4, 19.5

(56) References Cited

U.S. PATENT DOCUMENTS

| | | | | |
|---|---|---|---|---|
| 2,555,333 | | 6/1951 | Grand et al. | 149/92 |
| 3,609,115 | * | 9/1971 | Sammons et al. | 260/32.4 |
| 3,613,597 | * | 10/1971 | Warren et al. | 102/100 |
| 3,811,358 | * | 5/1974 | Morse | 86/20 |
| 4,128,443 | * | 12/1978 | Pawlak et al. | 149/71 |
| 4,386,979 | | 6/1983 | Jackson, Jr. | 149/21 |
| 5,125,684 | | 6/1992 | Cartwright | 280/736 |
| 5,218,166 | * | 6/1993 | Schumacher | 102/431 |
| 5,403,035 | * | 4/1995 | Hamilton | 280/736 |
| 5,507,891 | | 4/1996 | Zeigler | 149/47 |
| 5,516,377 | * | 5/1996 | Highsmith et al. | 149/18 |
| 5,536,340 | * | 7/1996 | Ramaswamy | 149/35 |
| 5,898,126 | * | 4/1999 | Yoshida | 149/46 |

FOREIGN PATENT DOCUMENTS

| | | |
|---|---|---|
| 884 170 | 7/1953 | (DE) . |
| 2357303 | 5/1975 | (DE) . |
| 44 12 871 A1 | 10/1994 | (DE) . |
| 94 16 112 | 2/1995 | (DE) . |
| 94 16 112 U | 2/1995 | (DE) . |
| 44 11 654 A1 | 4/1995 | (DE) . |
| 195 48 917 A1 | 7/1996 | (DE) . |
| 195 31 130 A1 | 2/1997 | (DE) . |
| 0607446 A1 | 7/1994 | (EP) . |
| 0619284 A1 | 10/1994 | (EP) . |
| 659 714 A2 | 6/1995 | (EP) . |
| 0661253 A2 | 7/1995 | (EP) . |
| 0673809 A1 | 9/1995 | (EP) . |
| 5-213687 | 8/1993 | (JP) . |
| 5-254977 | 10/1993 | (JP) . |
| 6-227884 | 8/1994 | (JP) . |
| 6-239683 | 8/1994 | (JP) . |
| 6-57629 | 8/1994 | (JP) . |
| 7-61885 | 3/1995 | (JP) . |
| 7-223890 | 8/1995 | (JP) . |
| 8-231291 | 9/1996 | (JP) . |
| WO 96/25375 | 8/1996 | (WO) . |

* cited by examiner

*Primary Examiner*—Charles T. Jordan
*Assistant Examiner*—Aileen J. Baker
(74) *Attorney, Agent, or Firm*—Birch, Stewart, Kolasch & Birch LLP

(57) ABSTRACT

A gas generating composition having a low combustion temperature and a low heat of combustion at the time of burning and therefore enabling downsizing of gas generators themselves, which comprises as the essential components nitroguanidine and an oxidizing agent comprising (a) nitrates or nitrites of alkali metals or alkaline earth metals, (b) oxides or multiple oxides of metals selected from among copper, cobalt, iron, manganese, nickel, zinc, molybdenum and bismuth, or a mixture of the components (a) and (b).

15 Claims, No Drawings

GAS GENERATING COMPOSITION

TECHNICAL FIELD TO WHICH THE INVENTION BELONGS

The present invention relates to a gas generating composition which evolves a working gas in the air bag system to be mounted in automobiles, aircraft or the like for the protection of the human body.

PRIOR ART

Sodium azide is known to the public as the gas generating agent to be used in the air bag system for automobiles, aircraft or the like. Further, gas generating compositions comprising sodium azide are not particularly problematic in their burning characteristics and therefore are widely put to practical use. However, sodium azide has unfavorable disadvantages. For example, many patents in this field have pointed out various problems such as dangerous decompositional explosion, formation of explosive compounds by the reaction with heavy metals, environmental pollution caused by mass disposal of the waste and so on.

Meanwhile, investigations are in progress on the substitutes for sodium azide to solve these problems. For example, gas generating compositions comprising transition metal complexes of tetrazole or triazole are disclosed in JP-B 6-57629; ones comprising triaminoguanidine nitrate in JP-A 5-254977; ones comprising carbohydrazide in JP-A 6-239683; and ones comprising cellulose acetate and nitrogenous nonmetallic compounds such as nitroguanidine in JP-A 7-61885.

Further, U.S. Pat. No. 5,125,684 discloses the use of nitroguanidine as the energetic component to be made coexistent with 15 to 30% cellulose-based binder; and WO-A 96/25375 (published on Aug. 22, 1996) discloses combinations of nitroguanidine with silicon oxide or aluminum oxide.

When the burning of a nitrogenous organic compound is conducted by the use a stoichiometric amount of an oxidizing agent, i.e., such an amount to generate enough oxygen to complete the burning of carbon, hydrogen and other elements constituting the compound, the heat of combustion and the combustion temperature are disadvantageously generally higher than those found in the burning of azide compounds. In addition to the performance of a gas generating agent, it is essential for the inflater system for air bags that the system itself has a size that does not hinder the ordinary driving of an automobile. When a gas generating agent having a high combustion temperature and a high heat of combustion is used, however, the use of additional parts for heat removal is unavoidable in designing a gas generator, which makes it impossible to downsize a gas generator. In short, it is most preferable that a gas generating agent have a low combustion temperature and a low heat of combustion at the time of burning. Accordingly, it cannot be said that the known gas generating compositions described above are satisfactory in applicability to air bag systems.

DISCLOSURE OF THE INVENTION

The inventors of the present invention have intensively studied to solve the above problems, and the present invention has been accomplished as a result of the studies.

The present invention relates to a gas generating composition which comprises as the essential components nitroguanidine and an oxidizing agent comprising the following component (a) or (b) or a mixture of the components (a) and (b):

(a) nitrates or nitrites of alkali metals or alkaline earth metals, and (b) an oxide or a multiple oxide of a metal(s) selected from copper, cobalt, iron, manganese, nickel, zinc, molybdenum and bismuth.

The composition is preferably a combination of nitroguanidine with the component (b), or with the components (a) and (b).

The composition preferably comprises 20 to 80% by weight of nitroguanidine and 80 to 20% by weight of the oxidizing agent, and still preferably comprises 25 to 40% by weight of nitroguanidine and 75 to 60% by weight of the oxidizing agent.

The composition may further contain at most 5% by weight of a binder or binders based on the total weight of the composition.

The oxidizing agent is preferably one wherein the component (a) is an alkaline earth metal nitrate, more preferably strontium nitrate, one wherein the component (a) is an alkali metal nitrate, still preferably potassium nitrate, one wherein the component (b) is an oxide, more preferably copper oxide, or one comprising strontium nitrate and copper oxide.

The modes for carrying out the invention will now be described in detail.

The content of nitroguanidine in the gas generating composition of the present invention is preferably 20 to 80% by weight, more preferably 20 to 60% by weight, though it depends on the kind of the oxidizing agent and the oxygen balance. The content is most desirably 25 to 40% by weight because, in such a case, a gas generating composition comprising a copper oxide as the oxidizing agent exhibits a combustion temperature of 2200° K or below and a gas yield of 1.2 mol/100 g or above.

In the present invention, the above component (a) or (b) or a mixture of both is used as the oxidizing agent. Specific examples of (a) nitrites or nitrates of alkali metals or alkaline earth metals include alkali metal or alkaline earth metal salts of nitric acid, such as sodium nitrate, potassium nitrate, magnesium nitrate, strontium nitrate; and alkali metal or alkaline earth metal salts of nitrous acid, such as sodium nitrite, potassium nitrite, magnesium nitrite and strontium nitrite. On the other hand, specific examples of (b) oxides or multiple oxides of metals selected from copper, cobalt, iron, manganese, nickel, zinc, molybdenum and bismuth include $CuO$, $Cu_2O$, $Co_2O_3$, $CoO$, $Co_3O_4$, $Fe_2O_3$, $FeO$, $Fe_3O4$, $MnO_2$, $Mn_2O_3$, $Mn_3O_4$, $NiO$, $ZnO$, $MoO_3$, $CoMoO_4$, $Bi_2MoO_6$ and $Bi_2O_3$. Among these oxidizing agents, copper oxides are the most desirable.

The oxidizing agent to be used in the present invention may be any one selected from among the above compounds or any combination of two or more members selected from among them. The content of the oxidizing agent in the gas generating composition is preferably 80 to 20% by weight, still preferably 80 to 40% by weight. The content is most desirably 75 to 60% by weight because, in such a case, a gas generating composition comprising a copper oxide as the oxidizing agent exhibits a combustion temperature of 2200° K or below and a gas yield of 1.2 mol/100 g or above.

The gas generating composition of the present invention may further contain a binder or binders. The binder to be used in the present invention includes inorganic ones such as silica, alumina and molybdenum disulfide; and organic ones such as microcrystalline cellulose, POVAL and high-molecular-weight oligomers. It is preferable that the binder content of the composition be 5% by weight or below.

The gas generating composition of the present invention comprising nitroguanidine and the above oxidizing agent generally exhibits a lowered combustion temperature and a lowered total heat of combustion as compared with those of the gas generating compositions of the prior art. In particular, a composition comprising nitroguanidine and CuO is extremely excellent in these respects, thus being the most important combination. Further, this composition can change in the burning velocity and the pressure exponent by controlling the oxygen balance. The term "pressure exponent" as used in this description refers to the exponent "n" in the formula: burning velocity r (mm/sec)=a×p$^n$ (wherein a is a constant dependent on the constituents of a gas generating composition and initial temperature; and p is pressure (kgf/cm$^2$) of measurement). The above composition has the property that n approaches O as the oxygen balance shifts to the plus side, which is particularly preferable from the standpoint of the stability of combustion.

The gas generating composition of the present invention is preferably prepared by mixing the components in a powdery state, and the mixing can also be conducted according to a wet process in the presence of water or the like, at need. Prior to the use, the composition may, if necessary, be molded into a suitable shape such as granule, pellet or disk. Further, a composition having a low burning velocity may be molded by extrusion prior to the use.

The gas generating composition of the present invention is particularly useful for the air bag system to be mounted in automobiles, aircraft or the like for the protection of the human body.

The nitroguanidine contained in the gas generating composition of the present invention exhibits high long-term stability required of the air bag system and has excellent burning characteristics.

EXAMPLE

The present invention will now be described specifically by referring to the following Examples and Comparative Examples, though the present invention is not limited by them. In the following Examples and Comparative Examples, the compositions were pelletized in an ordinary manner before being examined.

Examples 1 to 5 and Comparative Examples 1 to 7

Table 1 shows the theoretical combustion temperatures of nitroguanidine-containing gas generating compositions according to the present invention. The Comparative Examples show the theoretical combustion temperatures of gas generating compositions (Comparative Examples 1, 2) comprising transition metal complexes of 5-aminotetrazole (5-AT) (disclosed in JP-B 6-57629), gas generating composition (Comparative Example 3) comprising triaminoguanidine nitrate (disclosed in JP-A 5-254977), gas generating composition (Comparative Example 4) containing carbohydrazide (disclosed in JP-A 6-239683), and gas generating compositions (Comparative Examples 5, 6 and 7) comprising cellulose acetate and nitrogenous nonmetallic compounds (disclosed in JP-A 7-61885).

Examples 6 to 14

A gas generating composition comprising nitroguanidine and CuO could change in combustion temperature, burning velocity, density of pellets of the gas generating composition and gas yield, by changing the mixing ratio of the components. The data are given in Table 2. Each burning velocity was determined under a pressure of 70 kgf/cm$^2$.

As will be understood from the results, the gas generating compositions of the present invention are superior to those of the prior art, particularly in combustion temperature, which paves the way to downsize gas generators and apply the technology to air bag systems.

TABLE 1

| | Compn. | (wt %) | Combustion temp. (° K.) |
|---|---|---|---|
| Ex. | | | |
| 1 | nitroguanidine/$KNO_3$ | (56.3/43.7) | 2200 |
| 2 | nitroguanidine/$Sr(NO_3)_2$/CuO | (40.3/19.2/40.5) | 2091 |
| 3 | nitroguanidine/CuO | (39.5/60.5) | 2043 |
| 4 | nitroguanidine/$KNO_3$/$Al_2O_3$ | (55.2/42.8/2.0) | 2172 |
| 5 | nitroguanidine/CuO/cellulose | (32.8/64.7/2.5) | 1928 |
| Comp. Ex. | | | |
| 1 | $Zn(5\text{-}AT)_2/Sr(NO_3)_2$ | (44.0/56.0) | 2411 |
| 2 | $[Cu(S\text{-}AT)_{2.1}/2H_2O]/Sr(NO_3)_2$ | (42/58) | 2390 |
| 3 | triaminoguanidine nitrate/$KClO_4$ | (57.9/42.1) | 2911 |
| 4 | carbohydrazide/$KClO_4$/CaO | (39/61/10) | 2825 |
| 5 | cellulose acetate/triacetin/$KClO_4$/nitroguanidine | (8/2/55/35) | 2834 |
| 6 | cellulose acetate/triacetin/$KClO_4$/triaminoguanidine nitrate | (8/4/57/31) | 2893 |
| 7 | cellulose acetate/triacetin/$KClO_4$/5-aminotetrazole | (10/5/65/20) | 2928 |

TABLE 2

| Compn. | (wt %) | Combustion temp. (° K.) | Burning velocity (mm/s) | Density (g/cm$^3$) | Gas yield (mol/100 g of gas generating compn.) |
|---|---|---|---|---|---|
| Ex. | | | | | |
| 6 nitroguanidine/CuO | (39.5/60.5) | 2043 | 4.3 | 2.54 | 1.90 |
| 7 nitroguanidine/CuO | (38/62) | 1992 | 4.9 | 2.56 | 1.83 |
| 8 nitroguanidine/CuO | (36/64) | 1922 | 5.8 | 2.58 | 1.73 |
| 9 nitroguanidine/CuO | (34/66) | 1850 | 6.9 | 2.63 | 1.63 |
| 10 nitroguanidine/CuO | (32/68) | 1774 | 8.8 | 2.71 | 1.54 |
| 11 nitroguanidine/CuO | (30/70) | 1695 | 9.1 | 2.76 | 1.44 |
| 12 nitroguanidine/CuO | (28/72) | 1604 | 10.6 | 2.83 | 1.35 |
| 13 nitroguanidine/CuO | (26/74) | 1526 | 11.0 | 2.94 | 1.25 |
| 14 nitroguanidine/CuO | (24.6/75.4) | 1517 | 9.5 | 2.94 | 1.18 |

What is claimed is:

1. A gas generating composition comprising nitroguanidine, a binder selected from the group consisting of alumina, molybdenum disulfide, microcrystalline cellulose, POVAL and high-molecular-weight oligomers, and an oxidizing agent having the following components (a) or (b) or a mixture of the components (a) and (b):

(a) nitrates or nitrites of alkali metals or alkaline earth metals, and (b) oxides or multiple oxides of metals selected from the group consisting of copper, cobalt, iron, manganese, nickel, zinc, molybdenum and bismuth.

2. The composition according to claim 1, which comprises 20 to 80% by weight of nitroguanidine and 80 to 20% by weight of the oxidizing agent.

3. The composition according to claim 1, which comprises 25 to 40% by weight of nitroguanidine and 65 to 75% by weight of the oxidizing agent.

4. The composition according to claim 1, wherein the component (a) is an alkaline earth metal nitrate.

5. The composition according to claim 4, wherein the component (a) is strontium nitrate.

6. The composition according to claim 1, wherein the component (a) is an alkali metal nitrate.

7. The composition according to claim 6, wherein the component (a) is potassium nitrate.

8. The composition according to claim 1, wherein the component (b) is an oxide.

9. The composition according to claim 8, wherein the component (b) is a copper oxide.

10. The composition according to claim 1, wherein the oxidizing agent comprises strontium nitrate and a copper oxide.

11. The composition according to claim 1, wherein the amount of the binder is 5% by weight or below based on the total amount of the composition.

12. The composition according to claim 1, wherein the binder is selected from the group consisting of silica, alumina, molybdenum disulfide, microcrystalline cellulose, POVAL and high-molecular-weight oligomers.

13. The composition according to claim 1, wherein the oxidizing agent is the component (a).

14. The composition according to claim 1, wherein the oxidizing agent is the component (b).

15. The composition according to claim 1, wherein the oxidizing agent is a mixture of the components (a) and (b).

* * * * *